United States Patent [19]

Petit

[11] 3,985,207

[45] Oct. 12, 1976

[54] ELEVATOR BRIDGE WITH COLUMNS

[75] Inventor: Georges Petit, St. Loup, France

[73] Assignee: Alfio Maccarone, Rueil Malmaison, France

[22] Filed: June 12, 1975

[21] Appl. No.: 586,417

[30] Foreign Application Priority Data

June 13, 1974 France ..... 74.20483

[52] U.S. Cl. ..... 187/8.5; 187/8.54; 187/8.59

[51] Int. Cl.[2] ..... B66F 7/00

[58] Field of Search ..... 187/8.41, 8.47, 8.49, 187/8.5, 8.54, 8.59, 8.75; 254/89 R, 89 H

[56] References Cited

UNITED STATES PATENTS

| | | | |
|---|---|---|---|
| 2,059,059 | 10/1936 | Thompson | 187/8.47 |
| 2,139,597 | 12/1938 | Martin | 187/8.59 |
| 2,238,573 | 4/1941 | Steedman | 187/8.59 |
| 2,593,635 | 4/1952 | Walker | 187/8.75 |
| 2,843,223 | 7/1958 | Villars | 187/8.59 |
| 3,117,652 | 1/1964 | Wallace | 187/8.75 |
| 3,291,260 | 12/1966 | Woor et al. | 187/8.47 |
| 3,724,602 | 4/1973 | Hernick | 187/8.54 |
| R25,923 | 12/1965 | Powell | 187/8.59 |

FOREIGN PATENTS OR APPLICATIONS

| | | | |
|---|---|---|---|
| 885,599 | 12/1961 | United Kingdom | 187/8.5 |

*Primary Examiner*—John J. Love
*Assistant Examiner*—Jeffrey V. Nase

[57] ABSTRACT

A lift mechanism having vertical columns and including manually positionable load supporting arms which may be manipulated so as to engage a raised load thus permitting lowering of the lift. The lift mechanism is further characterized by a safety system which prevents operation of the lift unless the load supporting arms are all fully retracted from the path of the lift or all fully extended under the load. The safety system includes kinematically coupled latch members which move with the lift and engage apertures of vertically spaced arrays located in each support column of the lift.

10 Claims, 8 Drawing Figures

FIG.6
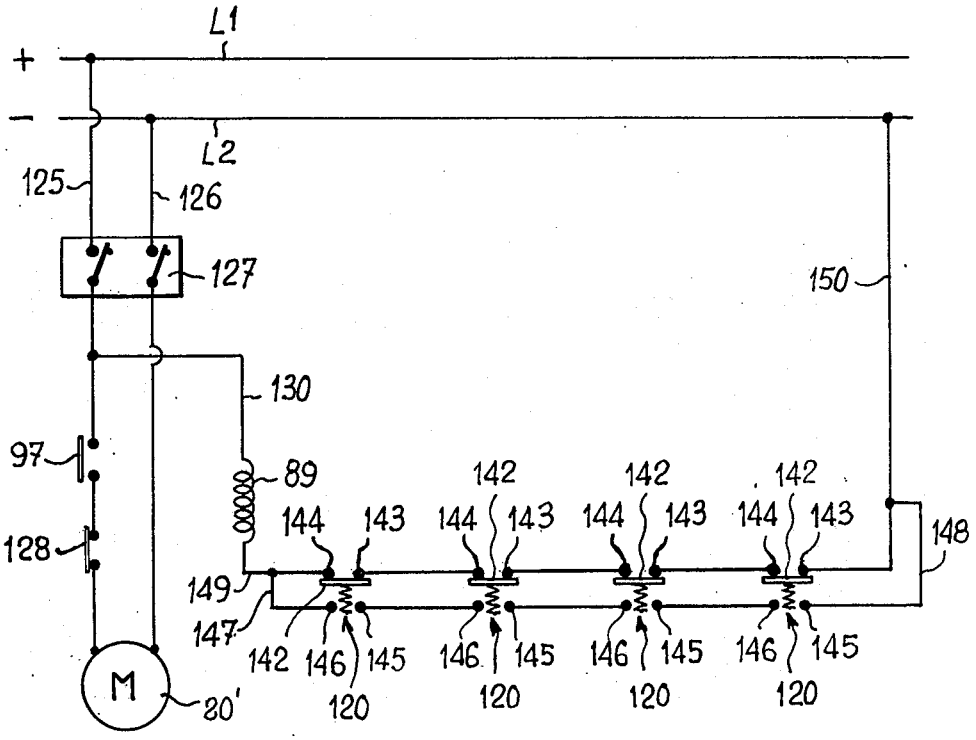
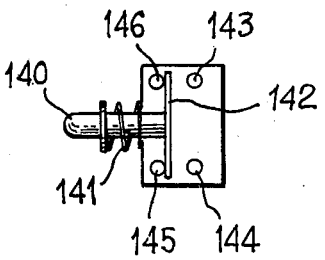
FIG.8

ELEVATOR BRIDGE WITH COLUMNS

BACKGROUND OF THE INVENTION:

1. Field of the Invention

The present invention relates to the lifting of objects and particularly to the raising of vehicles to an elevated position in the interest of facilitating the servicing thereof. More specifically, this invention is directed to lift mechansims of the elevator bridge type wherein a load is supported on a vertically movable member or members which extend transversely between vertical columns. Accordingly, the general objects of the present invention are to provide novel and improved methods and apparatus of such character.

2. Description of the Prior Art

Elevator bridges or lifts employing a pair of vertical columns which guide a vertically movable horizontal load supporting member are known in the art. Lifts of this type have the disadvantage that they can only be employed with comparatively lightweight loads. Also, the vertically movable support member which extends between the columns must be of a rather substantial size when compared to the load and thus, in the case of a lift designed for the raising of motor vehicles, the support member impedes access to certain parts of the vehicle.

Elevator bridge type lifts with four columns are also known. Such four column units employ a pair of horizontally oriented support members guided in pairs of columns. The support members in turn support transversely oriented parallel runways. In such four column lifts the runways impede access to certain parts of the vehicle being serviced and, because the vehicle rests oon its wheels, a number of adjustments and checking operations are not possible. In order to obviate these drawbacks it has been proposed to place jacks on the runways in order to raise the vehicle in relation to the runways. For obvious reasons, including the inability to obtain sufficient clearance between the runway and vehicle, the use of such auxiliary jacks is an unacceptable solution. In addition, the use of a plurality of jacks mounted on the runways is an expensive and complicated approach which carries with it an inherent safety risk.

SUMMARY OF THE INVENTION

The present invention overcomes the above briefly discussed and other deficiencies and disadvantages of the prior art by providing a novel and improved lift assembly including at least one and preferrably two pair of vertical columns which guide horizontally oriented and vertically movable support members.

Apparatus in accordance with the present invention includes a mechanical safety device which prevents untimely lowering of the lift while not interferring with the raising thereof. Apparatus in accordance with the present invention may also be characterized by independently positionable, pivotal load receiving arms which may be caused to engage the underside of a raised load whereupon the support member or members guided in the vertical columns may be lowered. This arrangement affords the advantage that any components to be removed from the load, such as the engine of a vehicle, may be lowered by the lift mechanism while the load remains in the raised position.

In accordance with a preferrred embodiment, the load receiving arms which may be engaged with the load after it has been raised are provided with a counter-balancing means to facilitate the positioning thereof.

Also in accordance with a preferred embodiment, the present invention is provided with an electrical interlock system which serves to prevent vertical movement of a load with the arms in a position which would impede such movement.

BRIEF DESCRIPTION OF THE DRAWING:

The present invention may be better understood and its numerous objects and advantages will become apparent to those skilled in the art by reference to the accompanying drawing wherein like reference numerals refer to like elements in the several figures and in which:

FIG. 6 is an electrical schematic diagram of the control circuit in accordance with a preferred embodiment of the invention;

FIG. 8 is a representation of a safety interlock switch of the type depicted in FIGS. 5 and 6.

DESCRIPTION OF THE PREFERRED EMBODIMENT

Figure 1:
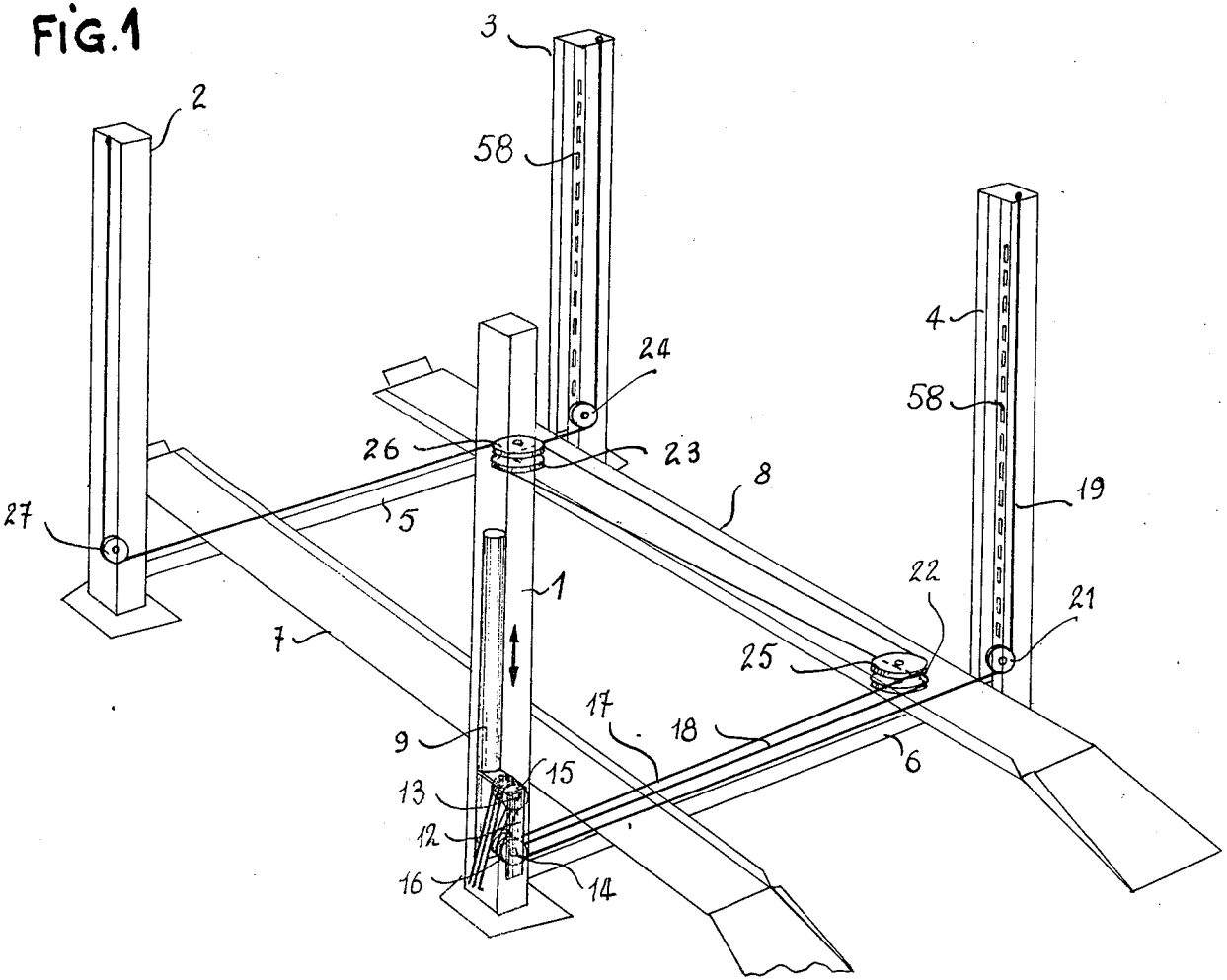
FIG. 1 is a schematic diagram, in perspective, of a four column lift in accordance with a preferred embodiment of the present invention.

With reference now to the drawing, a vehicle lift in accordance with a preferred embodiment of the invention comprises vertical columns 1, 2, 3 and 4. These four vertical columns are arranged in a rectangular pattern. A first vertically movable support member 6 extends transversely between columns 1 and 4 and a second vertically movable support member 5, oriented parallelly to member 6, extends between columns 2 and 3. A pair of ramps or runways 7 and 8 are positioned on and movable transversely of the support members 5 and 6; the spacing between the ramp members 7 and 8 being adjustable to accomodate the dimensions of a vehicle to be raised.

Figure 2:
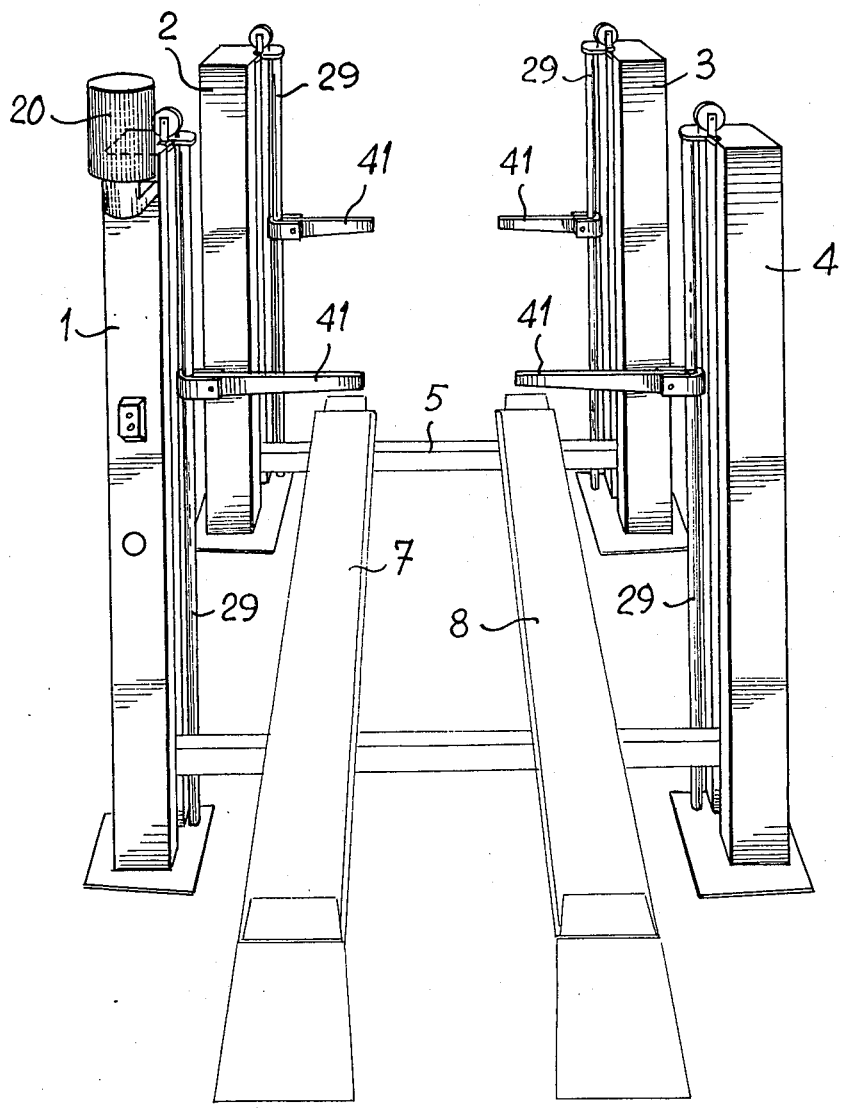
FIG. 2 is a perspective view of a four column lift assembly in accordance with the invention, the apparatus of FIG. 2 being characterized by the addition of independently positionable load receiving arms to the mechanism of FIG. 1.
Figure 7:
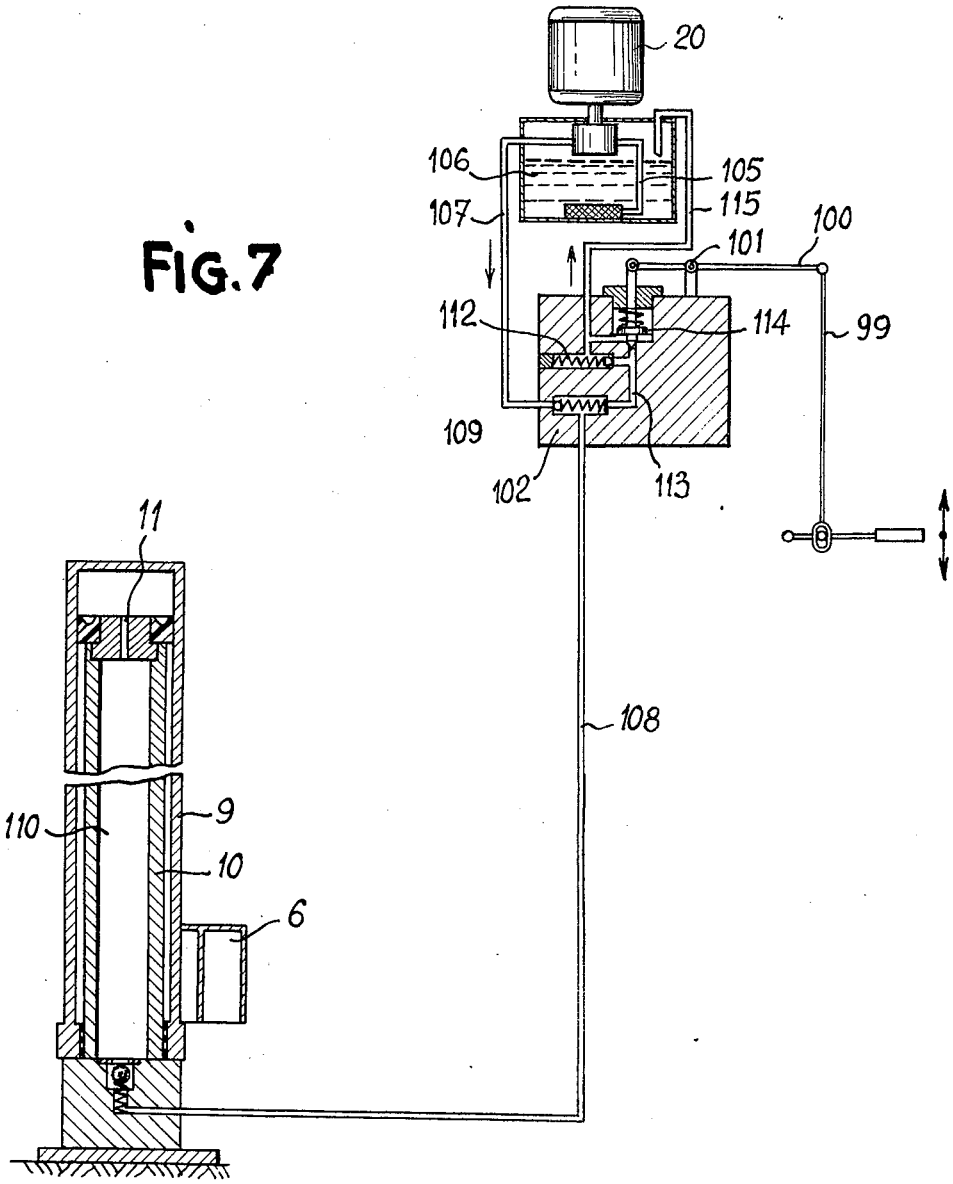
FIG. 7 is a schematic diagram of a hydraulic control circuit for use with a preferred embodiment of the invention.

As may best be seen from joint consideration of FIGS. 1, 2 and 7, column 1 of the lift assembly is provided with a piston-cylinder arrangement. This piston-cylinder arrangement includes a movable cylinder defining member 9 and a piston 10 which is fixed to and integral with the base of column 1. The piston 10 is hollow and is provided, at its upper end, with an aperture 11 through which communication with the interior of cylinder 9 is established. In the manner to be described below, the interior of piston 10 may be connected to a lift pump 20, typically mounted at the top of column 1 as shown in FIG. 2, whereby a pressurized hydraulic fluid may be delivered to the interior of cylinder 9 through piston 10. Means are provided to relieve pressure within cylinder 9 by returning fluid supplied thereto through the action of pump 20 to a reservoir.

Referring again to FIG. 1, a support bracket 12 which includes a pair of parallel horizontal flanges 13 and 14 extends from and is integral with cylinder 9. Flanges 13 and 14 respectively support sets of three freely rotatable pulleys 15 and 16. Cables 17, 18 and 19 are passed over respective pulleys of each of sets 15 and 16 and are anchored, at first ends, to the base of column 1. The cables extend through the interior of the support member 6 with cable 19 passing over a pulley 21 at the end of support member 6 disposed within column 4; pulley 21 rotating about a horizontal axis. The second end of cable 19 is affixed to the upper end of column 4. The structure of the columns 1, 2, 3 and 4 which permits this arrangement and particularly the location of pulley 21, may best be seen from FIG. 5.

The cable 18 is passed over a pulley 22, which freely rotates about a vertical shaft within member 6, and continues about a pulley 23, which is mounted for free rotation about a vertical shaft within support member 5. Cable 18 thereafter passes around a freely rotatable pulley 24 at the end of support member 5 disposed within column 3 and the second end of cable 18 is affixed to the top of column 3. Similarly, the cable 17 is passed around a pulley 25 coaxial with pulley 22, then around a pulley 26 coaxial with pulley 23, along the interior of support member 5, about a pulley 27 located at the end of member 5 disposed within column 2 and the second end of cable 17 is connected to the top of column 2.

To briefly summarize the operation of the components of the lift described above, the horizontal support members 5 and 6 are respectively guided along columns 2 and 3 and columns 1 and 4 and are raised and lowered simultaneously through the exercise of control over the cylinder-piston assembly with lifting force being transmitted to the ends of the horizontal support members via the cables 17, 18 and 19. Restated, when fluid under pressure is delivered to the interior of cylinder 9, the cylinder will move upwardly carrying the first end of member 6 and the pulley support bracket 12. This action will transmit a lifting force, via the cables, to the ends of support members 5 and 6 located within columns 2, 3 and 4 whereby the support members will move parallelly upward with the end of support member 6 affixed to cylinder 9 and the pulley support bracket 12. Safety means of the parachute type, which will be described below, is provided to prevent any sudden and undesired descent of the support members 5 and 6 from the raised position.

Figure 3:
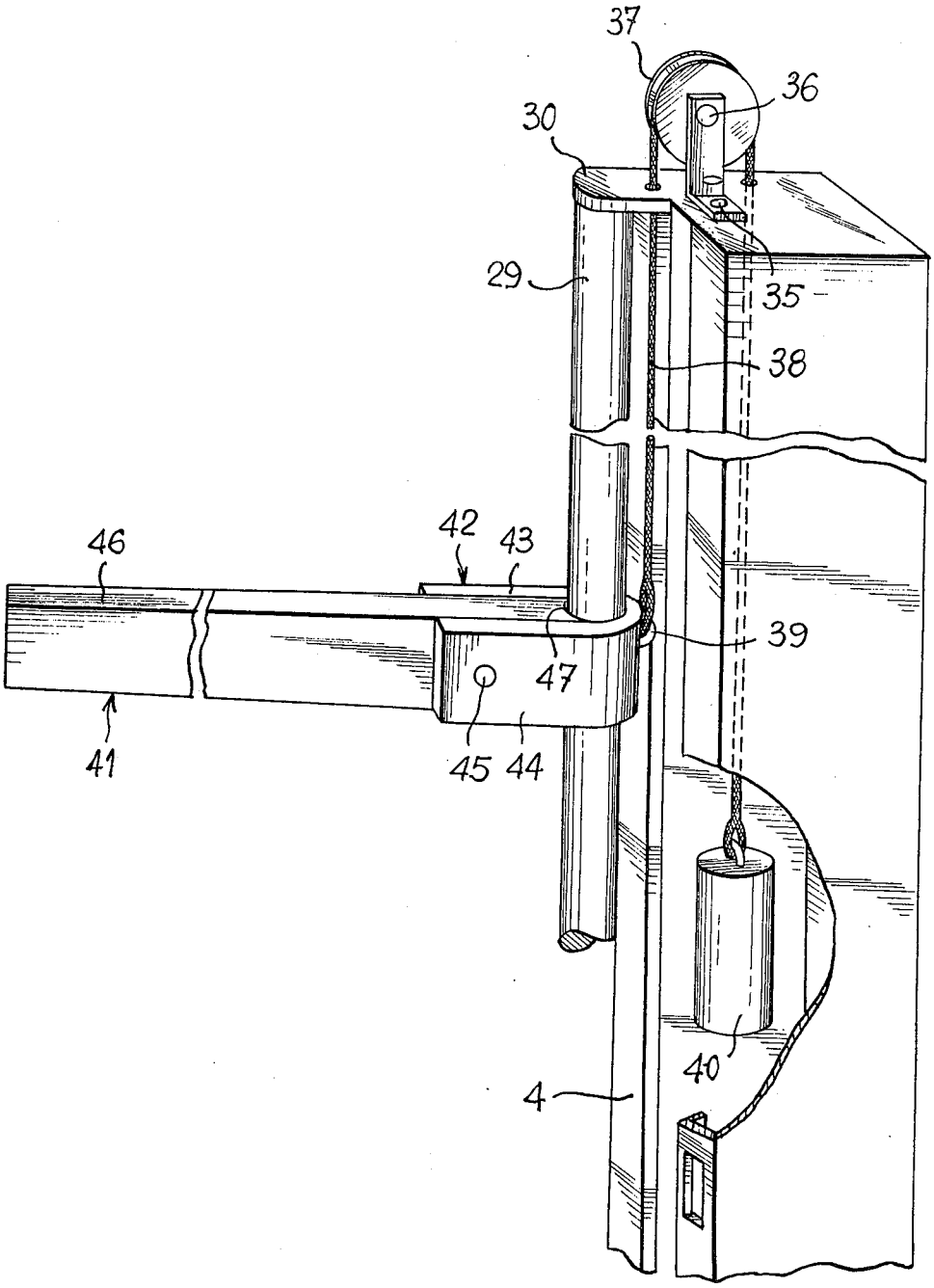
FIG. 3 is a perspective view, partly broken away, of a portion of one of the columns of the lift of FIG. 2.

As may best be seen from a joint consideration of FIGS. 2 and 3, each of the vertical columns 1–4 comprises a vertical bar 29. The lower end of each bar 29 is integral with the base of its respective columns and the upper end of each bar is, as may be seen in the case of column 4 in FIG. 3, affixed to a flange 30 extending from the top of the column. The top of each of the columns, in addition to the horizontally outwardly extending flange 30, is provided with an L-shaped bracket 35 which supports, on a horizontal shaft 36, a freely rotatable pulley 37. The pulleys 37 serve as guides for cables 38. A first end of each cable 38 extends downwardly into the column and has connected thereto a counterweight 40. The second end of each of cables 38 is attached to a ring 39 which is affixed to an arm, indicated generally at 41 in FIG. 3, which is movable on each of bars 29.

Continuing with a discussion of FIGS. 2 and 3, the arms 41 comprise U-shaped brackets, indicated generally at 42, having wings 43 and 44. The brackets 42 extend around the vertical bars 29 and are connected, by means of pins 45, to load support arms 46. The inner end of each of arms 46 is provided with an arcuate heel portion 47 which faces the bar 29. The greater the weight supported on arm 46 the more firmly its heel portion 47 will be urged against bar 29 thus preventing slippage in the vertical direction. There is, however, sufficient clearance between the bar 29 and the passage defined by bracket 42 and heel portion 47 of arm 46 such that the entire arm assembly 41 may be pivoted about bar 29 when in the unloaded condition.

Figure 4:
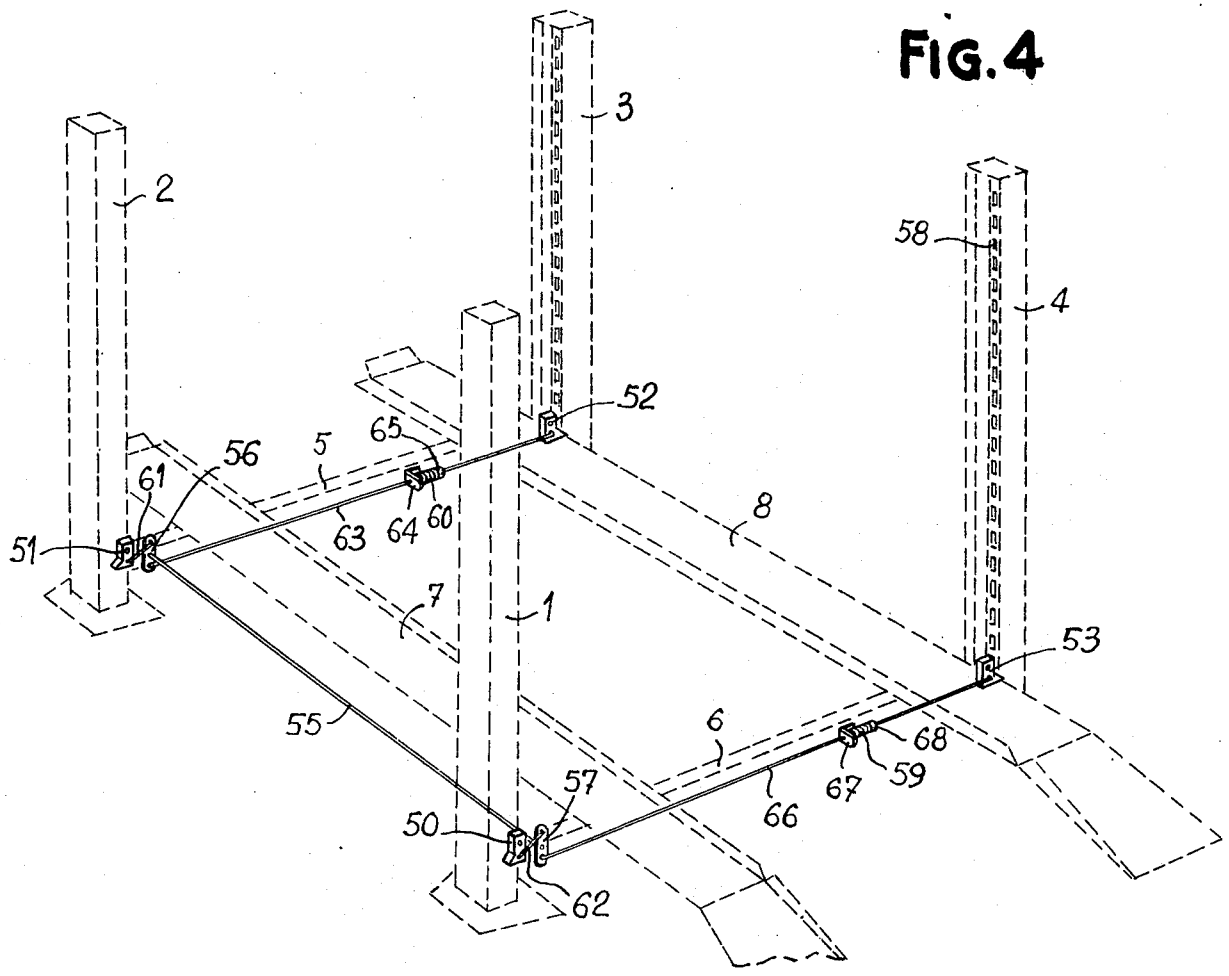
FIG. 4 is a schematic diagram, in perspective, of a mechanical safety latching mechanism intended for incorporation in the lift assemblies of FIGS. 1 and 2.
Figure 5:
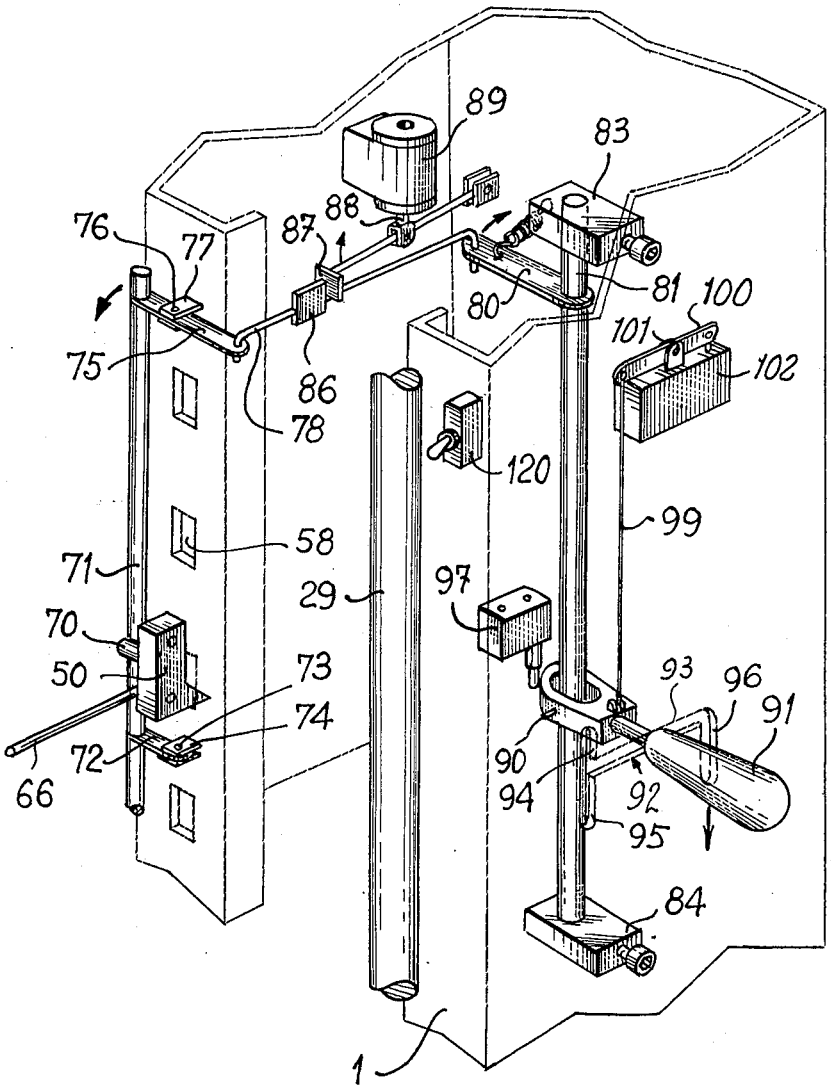
FIG. 5 is an enlarged perspective view of a safety and control system intended for use with the latching mechanism of FIG. 4.

Considering now FIGS. 4 and 5, the above briefly mentioned safety device is shown in detail. The saftey device includes pawl-type latch members 50, 51, 52 and 53; the latch members 50 and 53 being articulated to shafts carried with horizontal support member 6 and latch members 51 and 52 being articulated to shafts carried with the horizontal support member 5. A rod 55 rotatably mounted in bearings, not shown, in each of support members 5 and 6 interconnects, in the manner to be described below, the four latch members. Rod 55 is provided, at its opposite ends, with respective crank members 56 and 57 which are capable of rotation about the axis of rod 55. As may best be seen from FIG. 5, each of columns 1, 2, 3 and 4 is provided with vertically aligned spaced apertures 58. The latch members 50–53 engage the wall of apertures 58 and, in the unactuated condition, the upper arm cam surface on each latch permits raising of the horizontal support members 5 and 6 but prevent the lowering thereof. The latch members are spring loaded into the unenergized position which prevents downward motion of the support members.

Continuing with a discussion of the safety mechanism, a first end of the lever 56 is articulated to a first end of a connecting rod 61. The second end of lever 56 is attached to a first end of a connecting rod 63. The connecting rod 63 intermediate its length, passes through a bracket 64 which is affixed to support member 5. The second end of rod 63 is connected to latch member 52. The bracket 64 forms a first stop for a compression spring 60. The second end of spring 60 acts against a stop 65 on rod 63. In a similar manner, connecting rods 62 and 66 are articulated to opposite ends of the lever 57 and are respectively connected to latch members 50 and 53. The transverse rod 66 passes through a stop bracket 67 on support member 6 and a spring 59, which is in compression with a stop 68 on rod 66, is mounted on rod 66. As will be obvious, the springs 59 and 60 respectively urge the latch members 50, 53 and 51, 52 into engagement with the apertures in the vertical support columns.

The pawl 50 is provided with a laterally extending lug 70 which interacts, in the manner to be described below, with a bar 71 to effect release of the parachute-type safety device. The release bar 71 is articulated to the column 1 at a minimum of two points. Thus, as may be seen from FIG. 5, bar 71 is provided with radially extending arms 72 and 75 which pass through respective brackets 74 and 77. The brackets 74 and 77 are affixed to column 1 and the arms 72 and 75 are connected, respectively by pivot pins 73 and 76, to brackets 74 and 77 whereby the bar 71 is capable of a limited degree of rotational movement about the axis of pins 73 and 76. The radially extending arm 75 passes through bracket 77 and the free end of this arm is engaged by the first end of a connecting rod 78. The second end of rod 78 engaged the first end of a lever arm 80 mounted on a shaft 81 which is capable of rotation in bearings 83 and 84. The connecting rod 78 carries a stop 86 which cooperates with a plate 87 mounted on the end of a pivotal shaft which is pinned to and operated by the plunger 88 of a solenoid 89.

An operating handle 91 is attached, by means of a pin 90, to the vertical shaft 81. Operating handle 91 is maneuverable in a guide slot, indicated generally at 92, formed in column 1. Slot 92 has a horizontal portion 93 and, respectively at the opposite ends thereof, a descending vertical portion 96 and aligned ascending vertical portion 94 and descending vertical portion 95. A switch 97 which supplies, in the manner indicated in FIG. 6, power for operation of the motor which drives pump 20 is mounted on column 1 in proximity to handle 91. Switch 97 is normally open and will be closed by movement of the control handle 91 into the ascending slot portion 94. A further connecting rod 99 extends between the operating handle 91 and a first end of a control lever 100 of a hydraulic distributor 102.

The hydraulic control circuit including the distributor 102 is shown schematically in FIG. 7. The pump 20 will typically be driven by an electrical motor 20' (FIG. 6). The pump 20 draws hydraulic fluid from a reservoir 106 via a conduit 105 and delivers it, via a further conduit 107, to the distributor 102. The fluid enters distributor 102 through a check valve 109. The downstream side of check valve 109 is connected, via conduit 108, with the interior of piston 10. The interior of piston 10, indicated in FIG. 7 as an axial conduit 110, communicates with the interior of cylinder 9 via an orifice 11. Thus, when pump 20 is energized, pressurized fluid will be delivered to the interior of cylinder 9 and will cause the cylinder defining member to move upwardly with respect to piston 10.

The distributor 102 includes a pressure limiter 112, a needle valve 114 and internal passages 113 which provides communication between the downstream side of check valve 109 and both the needle valve 114 and pressure relief device 112. A further conduit 115 defines a return path for fluid from distributor 102 to reservoir 106. Referring jointly to FIGS. 5 and 7, the operating mechanism for needle valve 114 is connected to the free end of lever 100 which may pivot about shaft 101 mounted on distributor 102.

Referring jointly to FIGS. 5, 6, and 8, additional safety is afforded by mounting, within each of columns 1, 2, 3 and 4, a normally open switch 120. Each of switches 120 comprise a finger 140 movable against the force of a restoring spring 141 and connected to a blade or contact member 142. One of switches 120 is shown in its normal position, to which it is urged by springs 141, in FIG. 8 and all four switches are shown in their second position, to which they are urged by the load support arms 41, in FIG. 6. In the first position the blades 142 bridge contacts 145 and 146 while the second position the contacts 143 and 144 are bridged. As may be seen from FIG. 5, the switches 120 are positioned on the columns such that they will be actuated when the load support arms 41 are rotated back against the columns.

As may be seen from FIG. 6, the motor 20' for pump 20 is supplied, via conductors 125 and 126, with current from a main supply circuit L1, L2. A main power switch 127 is interposed in conductors 125 and 126. Also interposed in conductor 125 is the aforementioned switch 97, operated by the control handle 91, and a normally closed limit switch 128 which is mounted on column 1 at a position commensurate with the upward limit of travel of the transverse support member 6. A branch conductor 130 in part defines a circuit parallel to the circuit for energizing motor 20 via switch 97. This parallel circuit includes the solenoid 89 and the contacts of switches 120. As may be seen from FIG. 6, the first pairs of contacts 143, 144 of the four switches 120 are connected in series in a first parallel circuit between solenoid 89 and a return conductor 150 and the second pairs of contacts 145, 146 of switches 120 are connected in series in a second parallel circuit between the solenoid 89 and return conductor 150. The parallel circuit including series connected switch contacts 145, 146 also includes conductors 147 and 148 and the two parallel circuits including the contacts of switches 120 are connected to solenoid 89 via conductor 149. Solenoid 89 will be energized only when the contacts of all four switches 120 are either in the first ot in the second position.

In operation a vehicle to be raised is placed on the runways 7 and 8 after the load support arms 41 are positioned so as to extend in a direction substantially parallel to the runways; i.e., the load support arms 41 contact the operating fingers 140 of switches 120 and urge all four of these switches to the position where their contacts 145, 146 are closed. The operating handle 91 is then moved into the ascending slot 94 whereupon it causes the closing of the contact of switch 97 and the energization of pump motor 20'. The pump thereupon draws the hydraulic fluid from reservoir 106 and delivers it, via conduits 105 and 107, valve 109, conduit 108, conduit 110 and orifice 11 to the interior of cylinder 9. The cylinder 9 thus moves upwardly and, via the action of cables 17, 18 and 19, causes the transverse support members 5 and 6 to also ascend. When the support members 5 and 6 reach the desired level, the operating handle 91 is returned to the horizontal portion 93 of slot 92 thus deenergizing pump 20 through the opening of switch 97.

It is to be observed that the operating handle 91 can not be caused to enter slot 94 unless solenoid 89 is energized because rotation of bar 81 is prevented by the blocking action of plate 87 which contacts the stop 86 on connecting rod 78. Thus, it is essential that all of the load support arms 41 be rotated to the side and against their respective columns so as to interact with all of switches 120. When this condition is achieved, and main power switch 127 closed, solenoid 89 will be energized, the plate 87 lifted and rotation of bar 81 in response to the movements of handle 91 will be permitted. The operation of handle 91 into the slot 94 will also, with solenoid 89 energized, result in bar 71 pivoting outwardly from the columns and, through engagement of bar 71 with the lug 70 of latch member 50, the causing of the latch mechanisms 50, 51, 52 and 53 to move out of engagement with the apertures 58 in the columns.

When the transverse support members 5 and 6, and thus the vehicle load on the runways 7 and 8, is in the desired position and the pump has been deenergized, the load support arms 41 are pivoted about bars 29 and are caused to slide vertically along the bars until the arms 46 contact the underside of the chassis of the vehicle. The transverse support members 5 and 6 may thereupon be lowered; the weight of the vehicle on the arms 46 preventing any vertical movement of the load support arms.

For the lowering action the operating handle 91 is moved into the descending slot portion 95. This movement of the operating handle is permitted due to the fact that the solenoid 89 will be energized since all of the switches 120 are in their second closed position with contacts 145 and 146 bridged. Movement of operating handle 91 into slot portion 95 causes the rod 81 to pivot in the clockwise direction whereupon lever 80 exerts a pull on connecting rod 78 which, in turn, causes lever 75 to urge rod 71 away from column 1 thus disengaging the latch member 50 from one of apertures 58. Since all of the latch members 50, 51, 52 and 53 are kinematically interconnected, all will be simultaneously disengaged. The positioning of the operating handle 91 in slot 95 also results, through the action of connecting rod 99 and lever 100, in the opening of the needle valve 114 of distributor 102. The opening of needle valve 114 permits the return of pressurized fluid from the interior of cylinder 9 to reservoir 106 via conduit 108, passage 113 and condiut 115.

When the work to be done on the vehicle has been completed and it is to be returned to the ground, the operating handle 91 is again moved into the ascending slot 94 and the tranverse support members 5 and 6 will move upwardly until they again engage the vehicle and lift it sufficiently to take the load off the load support arms 41. The load support arms 41 can then be pivoted back to the position where they contact the fingers of switches 120 thus reenergizing solenoid 89 through the closing of the contact 143 and 144 of each of switches 120. Thereafter, to lower the vehicle, it is only required to return the operating handle 91 to the descending slot 95 thus reopening the needle valve 114 in the manner described above.

It will be understood that if one of the load support arms 41 does not occupy the ocrrect position, the blade 142 of its corresponding switch 120 will be applied against the wrong pair of contacts and the energizing circuit for solenoid 89 will remain open. Accordingly, the latch members will remain in engagement with the apertures 58 in the columns since the cooperative action between plate 87 and stop 86 will prevent the rotation of rod 81.

For certain operations the runways 7 and 8 must be positioned in the same horizontal plane. When the lift is erected the columns 1, 2, 3 and 4 a repositioned and mounted such that the lower edge of each aperture 58 is situated at a certain given height so as to occupy the same horizontal plane as the lower edge of the corresponding apertures in the other columns. If it is desired to cause the vehicle to rest on a perfectly horizontal plane, the operating handle 91 may be moved into the descending slot 96 thereby causing opening of the needle valve 114 without releasing the latch members 50, 51, 52 and 53. When this happens the transverse support members 5 and 6 will be supported by the latch members rather than by cables 17, 18 and 19 and the load on the lift will inherently be supported on a horizontal plane.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for supporting and raising loads comprising:

at least a pair of spatially displaced upwardly extending parallel columns;

a movable horizontal support member extending between said columns;

means for imparting movement to said support member to cause said support member to move along said columns in such a manner that the end thereof are always in a common horizontal plane;

load support means positioned on said support member for receiving and supporting a load to be raised;

locking means for preventing unintentional lowering of said support member from a raised position, said locking means being carried by said support member and operatively engaging at least one of said columns;

means for releasing said locking means to permit lowering of said support member from a raised position;

vertically oriented bar means mounted from each of said columns; and load receiving arm means mounted for movement on each of said bar means independently of movements of said support member, said arm means each being pivotal about respective of said bar means between a load engaging position and an inoperative position, said arm means not interfering with the raising and lowering of the load when in the inoperative position, said arm means being capable of supporting the load when in the operative position whereby said support member may be lowered and the load will remain in a raised position.

2. The apparatus of claim 1 wherein said columns are vertically oriented and are provided with facing slots for receiving and guiding oppositely disposed ends of said support member and wherein said bar means are mounted on the facing sides of said columns adjacent the support member guiding slots therein.

3. The apparatus of claim 2 further comprising:

pulley means mounted at the top of each of said columns;

a counterweight positioned for vertical movement; and cable means extending from said counterweight over said pulley to each of said load receiving arm means.

4. The apparatus of claim 1 wherein said load receiving arm means each comprises:

a generally U-shaped base member, said base member extending around said bar means;

a horizontally extending arm attached to said base member, said arm being received between the legs of said base member and being provided with an arcuate recess complimentary in shape to said bar means in an end thereof, said end of said arm with said arcuate recess being received in said base member and cooperating with said bar means to support a load in the raised position when the weight of the load is imposed thereon.

5. The apparatus of claim 1 further comprising:

means for preventing operation of said releasing means unless all of said load receiving arm means are in the operative position or all of said load receiving arm means are in the inoperative position.

6. The apparatus of claim 5 wherein said locking means comprises:

a plurality of mechanically interconnected pivotal latch members;

recesses provided in facing surface portions of each of said columns, said recesses being engaged by said latch members; and means for pivoting said latch members out of engagement with said column recesses; and wherein said means for preventing operation of said releasing means comprises:

means for preventing the pivoting of said latch members out of engagement with said recesses unless all of said load receiving arms are either in the operative or inoperative position.

7. The apparatus of claim 6 wherein said columns are vertically oriented and are provided with facing slots for receiving and guiding oppositely disposed ends of said support member and wherein said bar means are mounted on the facing sides of said columns adjacent the support member guiding slots therein.

8. The apparatus of claim 7 further comprising:

pulley means mounted at the top of each of said columns;

a counterweight positioned for vertical movement; and cable means extending from said counterweight over said pulley to each of said load receiving arm means.

9. The apparatus of claim 8 wherein said load receiving arm means each comprises:

a generally U-shaped base member, said base member extending around said bar means;

horizontally extending arm attached to said base member, said arm being received between the legs of said base member and being provided with an arcuate recess complimentary in shape to said bar means in an end thereof, said end of said arm with said arcuate recess being received in said base member and cooperating with said bar means to support a load in the raised position when the weight of the load is imposed thereon.

10. The apparatus of claim 1 wherein said apparatus further comprises:

a control lever;

a guide slot in one of said columns for determining the motion of said control lever, said guide slot having a horizontal neutral portion, an ascending portion and at least a first descending portion;

first means for energizing said movement imparting means to cause raising of said support member, said first energizing means being positioned so as to be contacted by said control lever when in the ascending slot portion;

second means for energizing said movement imparting means to cause lowering of said support means, said second energizing means being operated in response to movement by said control lever into a descending slot portion;

a pivotal shaft connected to said control lever;

solenoid operated blocking means for preventing pivoting of said shaft unless all of said load receiving arm means are in the operative position or all of said load receiving arm means are in the inoperative position, said pivoting prevention means including:

a two position electrical switch mounted on each of said columns;

an actuator for each of said switches, said actuators extending in a position so as to be contacted by said arm means in the inoperative position; and means connecting said switch means in a pair of parallel circuits whereby the solenoid of said blocking means will be energized only when all of said arm means are in either the operative or inoperative position, energization of said blocking means solenoid permitting pivoting of said pivotal shaft.

* * * * *